US005431319A

United States Patent [19]

Cavadini et al.

[11] Patent Number: 5,431,319

[45] Date of Patent: Jul. 11, 1995

[54] HOLDER FOR A COIN CUP

[76] Inventors: Michael Cavadini; Jeanne Cavadini, both of 14 State St., North Haven, Conn. 06473

[21] Appl. No.: 133,751

[22] Filed: Oct. 7, 1993

Related U.S. Application Data

[63] Continuation of Ser. No. 927,130, Aug. 7, 1992, abandoned.

[51] Int. Cl.[6] ..... A45F 3/14

[52] U.S. Cl. ..... 224/258; 224/202; 224/250

[58] Field of Search ..... 224/148, 202, 250, 257, 224/258, 205

[56] References Cited

U.S. PATENT DOCUMENTS

| | | | |
|---|---|---|---|
| 156,930 | 11/1874 | Kollock | 224/205 |
| 1,060,257 | 4/1913 | Humphrey | 224/202 |
| 3,543,976 | 12/1970 | Ronald | 224/148 |
| 3,820,695 | 6/1974 | Pecjak | 224/148 |
| 4,127,223 | 11/1978 | Uchin | 224/250 |
| 4,754,903 | 7/1988 | Dennis | 224/148 |
| 4,974,761 | 12/1990 | Luque | 224/148 |

FOREIGN PATENT DOCUMENTS

| | | | |
|---|---|---|---|
| 9109551 | 7/1991 | WIPO | 224/258 |

*Primary Examiner*—Linda J. Sholl
*Attorney, Agent, or Firm*—John J. Daniels

[57] ABSTRACT

A holder for a coin cup. A loop strap member defines an opening to receive a coin cup. The loop strap member is effective for supporting the coin cup by demountably engaging with the peripheral surface of the coin cup. Gravity will then urge the coin cup into snug engagement with the loop strap member to be supported thereby. A shoulder strap member is fixed to the loop strap member so that the circumference of the loop strap member is bisected between its ends. In the preferred embodiment, the shoulder strap member is fixed to the loop strap member such that the circumference of the loop strap member is bisected in unequal lengths between the first end and the second end of the shoulder strap member. Thus, the center of support of the loop strap member by the shoulder strap member is offset from the center of gravity of the coin cup supported by the loop strap member and has a tendency to tip in a direction of the longer length of the bisected circumference of the loop strap. Thus, when in use, the shoulder strap member is supported around the neck of the user and the coin cup tips in the direction of the user's torso until it comes to rest against the torso to thereby place the coin cup in a stable-held position.

5 Claims, 4 Drawing Sheets

HOLDER FOR A COIN CUP

This is a continuation application of parent application Ser. No. 927,130 filed Aug. 7, 1992, now abandoned.

BACKGROUND OF THE INVENTION

The present invention pertains to a device for holding coin cups used to hold coins by patrons of gambling establishments.

Gambling establishments customarily supply coin cups for their patrons for use in holding coins which are played in slot machines. Typically, a user will take a coin cup and fill it with a number of coins which are then used when playing the slot machines. This coin cup allows the user to carry the coins around in a convenient manner. Also, when the patron of the gambling establishment wins at the slot machine, the slot machine will expel numerous coins, the quantity of which depends on the particular win. These numerous coins are then placed in the coin cup by the winning patron and either spent again at the slot machine or other gambling tables, or kept by the patron as his winnings. In any case, the coin cup has become the means by which patrons of gambling institutions carry around their coins.

However, even though the coin cup makes it easier to carry around coins as compared with, for example, having to carry the coins in one's hand or one's pockets, the coin cup still has many inadequacies. For example, the coins carried in the coin cup become a heavy burden when carried by the user for a prolonged period of time. Also, because the coin cups of various individuals are identical, there is always the danger that one will set down his cup next to another individual's and pick up the wrong cup. Furthermore, patrons carrying around coin cups may be subject to pilfering by unscrupulous individuals at the gambling establishment when the cups are placed down as the player rests his arms.

In addition, gambling establishments often wish to promote their establishment using, for example, inexpensive items which may be used by the patrons of the gambling establishment while at the establishment. Furthermore, it is desirous that such items have some imprinting which affiliates the item with the particular gambling establishment or has some other promotional reason. Such gambling establishments also give away such items to their patrons, in which case the cost associated with each item is of particular importance and must be kept to a reasonable minimum. Additionally, such an item should have some useful purpose pertaining to the gambling experience and ideally will have a positive effect on the patron by, for example, reducing the fatigue associated with performing the gambling activity.

There has been an attempt in the past to provide a means for transporting a coin cup used by patrons at a gambling establishment. U.S. Pat. No. 4,978,761, issued to Luque, discloses a slot bag gambling accessory in which a closable pouch is used to transport a coin cup. However, among the many inadequacies of this prior attempt is the relatively complicated structure of the device which increases the cost and difficulty in manufacturing the device. Also, this prior attempt, which discloses a closable pouch to fully enclose the coin cup fails to provide an easily manufactured product which the gambling establishment can afford to give away to its patrons, while still providing a device which has utility when used by the patrons while performing a gambling activity at the gambling establishment. Thus, there is a need to provide an apparatus which is inexpensive to manufacture, durable, and provides the utility of supporting a coin cup used by the patron at the gambling establishment.

SUMMARY OF THE INVENTION

The present invention is intended to overcome the drawbacks of the prior art and to provide a holder for a coin cup which is inexpensive and easy to manufacture. It is an object of the present invention to provide such a coin cup holder which is constructed from durable, strong, and inexpensive material so as to enable participants at a gambling establishment to easily and securely carry around coins in the coin cup.

In accordance with the present invention, a holder for a coin cup is provided comprising a loop strap member. The loop strap member has a circumference and defines an opening configured and dimensioned to receive a coin cup within the circumference. The loop strap member is effective for supporting the coin cup by demountably engaging with the peripheral surface of the coin cup. In other words, a coin cup is slipped into the opening defined by the loop strap member and engages with the loop strap member to be supported thereby. Typically, a coin cup is manufactured with a tapered cylindrical form, therefore the base will fit through the opening and slide relative to the loop strap member until the circumference of the loop strap member is less than the circumference of the tapered coin cup. Gravity will then urge the coin cup into snug engagement with the loop strap member to be supported thereby. A shoulder strap, comprising a first end which is fixed at a portion along the length of the loop strap member and a second end which is fixed at another portion along the length of the loop strap member is provided. The shoulder strap is so fixed so that the circumference of the loop strap member is bisected between the first end and the second end. In the preferred embodiment of the inventive holder for a coin cup, the shoulder strap member is fixed to the loop strap member such that the circumference of the loop strap member is bisected in unequal lengths between the first end and the second end of the shoulder strap member. Thus, the center of support of the loop strap member by the shoulder strap member is offset from the center of gravity of the coin cup supported by the loop strap member. Thereby, the coin cup supported by the loop strap member has a tendency to tip in a direction of the longer length of the bisected circumference of the loop strap. Thus, when in use, the shoulder strap member is supported around the neck of the user and the coin cup tips in the direction of the user's torso until it comes to rest against the torso to thereby place the coin cup in a stable-held position. Further, the first end and the second end may be fixed slightly oblique relative to the perpendicular with the loop strap member. In other words, the first end and the second end are each fixed to the loop strap member by stitching or the like at a slight angle offset from the perpendicular angle between the longitudinal axis of the loop strap member and the length of the shoulder strap member. Thus, in use when the shoulder strap is disposed around the neck and/or shoulder of the user, the first end and second end are fixed so as to facilitate the loop strap member to be disposed as tending to be horizontal.

The shoulder strap member may also include shoulder strap adjusting means for adjusting the length of the shoulder strap member. Thus, the inventive holder for a coin cup may be used comfortably and effectively by users of different height. Also, the loop strap member may include loop strap adjusting means for adjusting the length of the loop strap member. Thus, the inventive holder for a coin cup may accommodate coin cups of varying diameter and size. The adjusting means for the shoulder strap and the loop strap may comprise, for example, a buckle, snaps, velcro, buttons, or the like. Also, indicia may be imprinted on either or both of the loop strap member and the shoulder strap member to indicate, for example, affiliation with a particular gambling establishment or for other promotional reasons. Preferably, the loop strap member and the shoulder strap member comprise a woven strap material such as nylon, polyester, cotton, or the like.

A method of making the inventive holder for a coin cup in accordance with the present invention, includes the steps of first providing a first length of strap material which has a first end and a second end. The loop strap member is formed by fixing the first end to the second end (by, for example, stitching, or other fastening means). A second length of strap material is provided also having a first end and a second end. The shoulder strap member is formed by fixing the first end to a portion of the loop strap member and fixing the second end to another portion of the loop strap member. Preferably, the first and second ends of the shoulder strap member are fixed to the loop strap member such that the circumference of the loop strap member is bisected in unequal lengths between the first end and the second end of the shoulder strap member. Adjusting means, such as a buckle, velcro, snaps, buttons, or the like may be provided for adjusting either or both of the loop strap member and shoulder strap member. Preferably, the first and second end of the shoulder strap member are fixed to the loop strap member by stitching. Indicia may be printed on the loop strap member and the shoulder strap member using, for example, screen printing, hot stamping, or any other printing method.

DETAILED DESCRIPTION OF THE INVENTION

Figure 1:
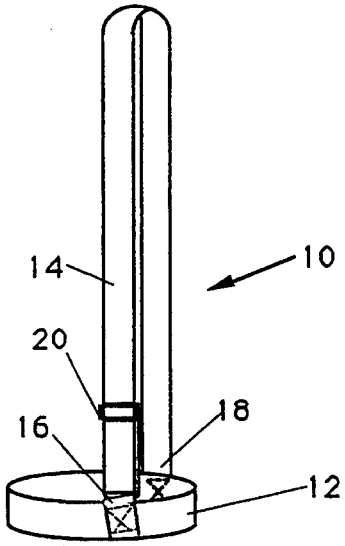
FIG. 1 is a perspective view of the inventive holder for a coin cup.

For purposes of promoting an understanding of the principles of the invention, reference will now be made to the embodiments illustrated in the drawings and specific language will be used to describe the same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

Referring to FIG. 1, a perspective view of the inventive holder for a coin cup 10 is shown. The inventive holder for a coin cup 10 includes a loop strap member 12 which has a circumference. The loop strap member 12 defines an opening which is configured and dimensioned to receive a coin cup within the circumference. The loop strap member 12 is effective for supporting the coin cup by demountably engaging with the peripheral surface of the coin cup (shown in FIG. 2). The inventive holder for a coin cup 10 further includes a shoulder strap member 14 which has a first end 16 fixed at a portion along the length of the loop strap member 12 and a second end 18 fixed at another portion along the length of the loop strap member 12. The first end 16 and second end 18 of the shoulder strap member 14 are fixed to the circumference of the loop strap member 12 so as to bisect the circumference of the loop strap member 12 between the first end 16 and the second end 18. Thus, a coin cup which is supported by the loop strap member 12 is in turn supported by the shoulder strap member 14 which may be, for example, placed around the shoulder and/or neck of a user to facilitate carrying coins in the coin cup. Further, the shoulder strap member 14 may include shoulder strap adjusting means 20 for adjusting the length of the shoulder strap member 14. Thus, the inventive holder for a coin cup 10 may be used comfortably by users having differing heights. In the preferred embodiment, the shoulder strap adjusting means 20 comprises a buckle. However, the shoulder strap adjusting means 20 may also be comprised of, for example; velcro, snaps, or the like.

Figure 2:
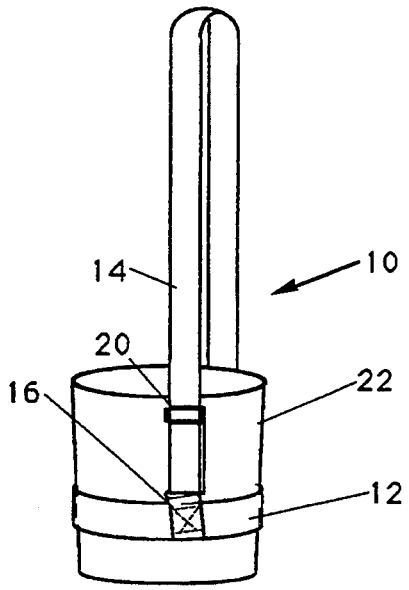
FIG. 2 is a perspective drawing of the inventive holder for a coin cup shown in FIG. 1 shown holding a coin cup.

Referring to FIG. 2, the inventive holder for a coin cup 10 is shown holding a coin cup 22. Coin cups 22 are generally formed having a taper. This taper is due to, among other reasons, the manufacture of the coin cup 22 which requires the mold which forms the coin cup 22 have a taper to facilitate removal of the coin cup 22 from the mold. The present invention utilizes this taper by providing a loop strap member 12 which has a circumference which allows the base of the coin cup 22 to easily pass within the circumference of the loop until the taper of the coin cup 22 causes the coin cup 22 to become demountably engaged with the loop strap member 12. Thus, the inventive holder for a coin cup 10 provides a very simple means for demountably engaging with and supporting the coin cup 22. This simple construction also allows the inventive holder for a coin cup 10 to be easily and inexpensively manufactured using inexpensive and durable materials.

In accordance with the preferred embodiment of the present invention, the shoulder strap member 14 is fixed to the loop strap member 12 such that the circumference of the strap member is bisected in unequal lengths between the first end 16 and the second end 18. In other words, the shoulder strap member 14 supports the loop strap member 12 in such a way that the center of gravity of a coin cup 22 supported by the loop strap member 12 is offset from the center of support of the loop strap member 12 by the shoulder strap member 14. This offsetting of the center of support creates a tendency for a coin cup 22 supported by the loop strap member 12 to tilt slightly in the direction of the longer length of the bisected circumference of the loop strap member 12. The advantage of this will be described in detail with reference to FIG. 3. Further, the first end 16 and the second end 18 may be fixed slightly oblique relative to the perpendicular with the loop strap member 12. In other words, the first end 16 and the second end 18 are each fixed to the loop strap member 12 by stitching or the like at a slight angle offset from the perpendicular angle between the longitudinal axis of the loop strap member 12 and the length of the shoulder strap member 14. Thus, in use when the shoulder strap is disposed around the neck and/or shoulder of the user, the first end 16 and second end 18 are fixed so as to facilitate the loop strap member to be disposed as tending to be horizontal.

Figure 3:
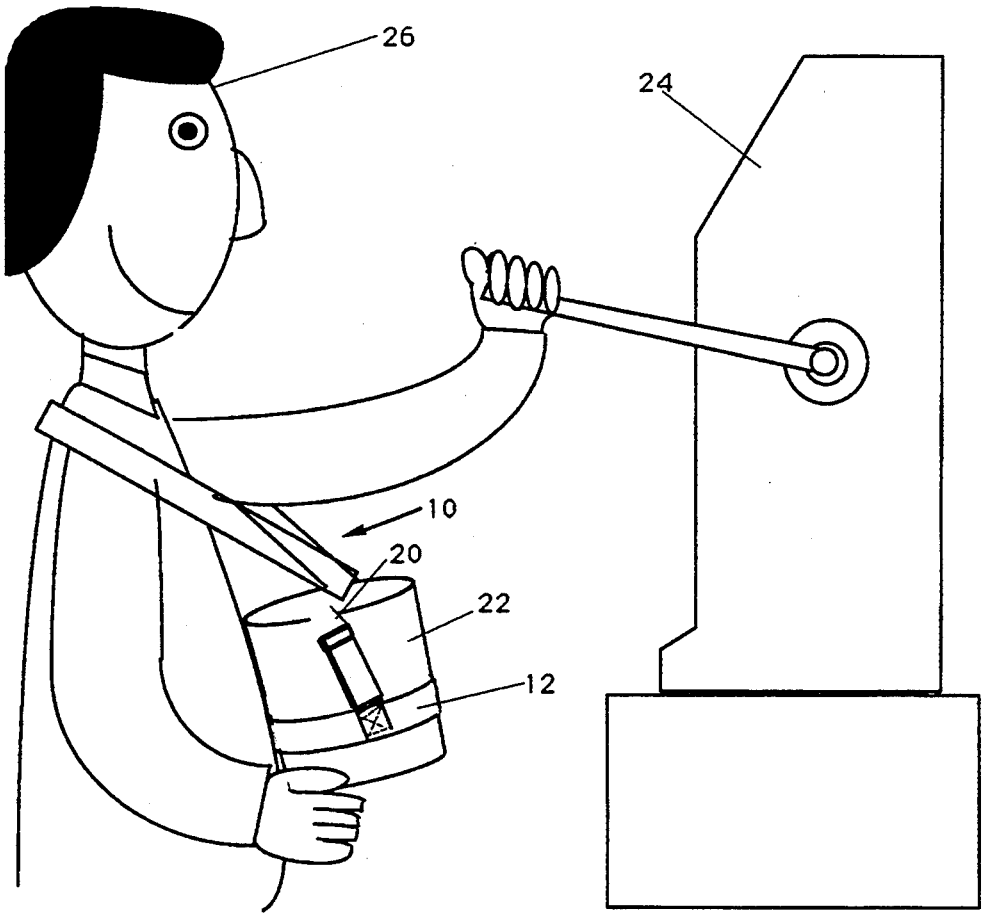
FIG. 3 is a view of the inventive holder for a coin cup shown in use by a user playing a slot machine.

Referring now to FIG. 3, the inventive holder for a coin cup 10 is shown in use by a user while playing a slot machine 24. When playing the slot machines, typically a user 26 will carry coins around in the coin cup 22 provided by the gambling establishment. However, when full of coins the coin cup 22 is heavy and it becomes difficult for the user 26 to carry the coin cup 22 around. Also, because the coin cups are indistinguishable and one user's cup looks like another user's cup there is the ever present danger that an unscrupulous individual will steal the coin cup 22 from an unsuspecting gambler. Also, there is always the possibility that the coin cups of the individuals will become mixed up when they are set down on a counter or the like. In accordance with the preferred embodiment of the present invention, a coin cup is demountably engaged with a loop strap member 12 by inserting the base of the coin cup 22 within the circumference of the loop strap member 12 so that the coin cup 22 is supported around its peripheral side by the loop strap member 12. Because the coin cup 22 generally has a taper, it is quite easy insert the coin cup 22 into the loop due to the fact that the loop has a wider circumference than the base of the coin cup 22. However, the taper of the cup and the action of gravity causes the loop strap member 12 to be tightly engaged with the peripheral side of the coin cup 22 so as to adequately support it. The shoulder strap member 14 is passed over the head of the user 26 and either an arm is inserted within the shoulder strap member 14, or as shown, the user 26 simply hangs the coin cup supported by the shoulder strap from around his neck. In accordance with the preferred embodiment of the present invention, the shoulder strap member 14 is fixed to the loop strap member 12 such that the circumference of the loop strap member 12 is bisected in unequal lengths between the first end 16 and second end 18 of the shoulder strap member 14. By doing so, when the user 26 is wearing the shoulder strap, the center of gravity of the coin cup is offset from the center of support of the loop strap member 12 so that there is a tendency for the coin cup to tip in the direction of the user's 26 torso. Thus, the coin cup comes to rest in contact with the user's 26 torso supported by the loop strap member 12 and therefore is less likely to tip forward spilling the coins from it.

Figure 4:
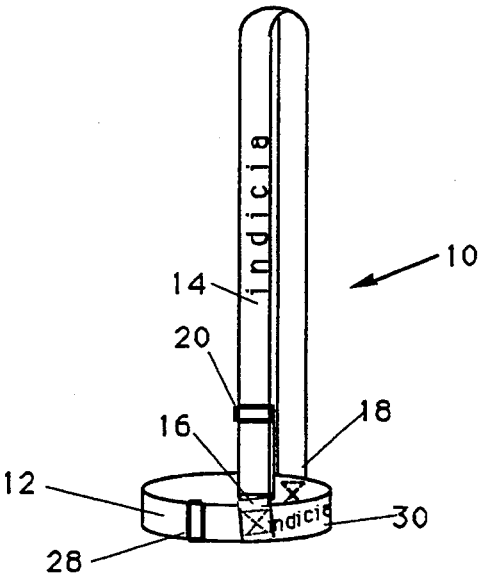
FIG. 4 is another embodiment of the inventive holder for a coin cup.

FIG. 4 shows an alternative embodiment of the inventive holder for a coin cup 10. In this embodiment, the loop strap member 12 may include loop strap adjusting means 28, such as a buckle, velcro, snaps, or the like, for accommodating coin cups of various circumferences. Thus, relatively larger and relatively smaller coin cups may be effectively supported and held by the inventive holder for a coin cup 10. Also, as shown in FIG. 4, indicia 30 may be applied to the externally exposed surfaces of the loop strap member 12 and/or the shoulder strap member 14 to indicate, for example, affiliation with a particular gambling establishment, or other promotional subject matter.

In accordance with the embodiments of the invention shown in FIGS. 1 through 4, a method of making the inventive coin cup holder 10 includes the steps of first providing a first length of strap material having a first end and a second end. The length of strap material is formed into a loop strap member 12 by fixing the first end to the second end. The first end may be fixed to the second end of the length of strap material by, for example, stitching. Alternatively, other fastening means may be used such as rivets, snaps, or the like. A second length of strap material is provided also having a first end 16 and a second end 18. The first and second ends 16 and 18 of the second length of strap material are fixed to portions of the loop strap material so as to form the shoulder strap member 14. Also, adjusting means, such as a buckle, may be included in the length of shoulder strap material and attached between the first and second ends 16 and 18 of the shoulder strap member 14. Furthermore, adjusting means may be provided between the first and second ends of the loop strap member 12. The shoulder strap member 14 may be fixed to the loop strap member 12 by stitches, snaps, or other fastening means. In the preferred embodiment, the shoulder strap member 14 is fixed to the loop strap member 12 such that the circumference of the loop strap member 12 is bisected in unequal lengths between the first end 16 and the second end 18 of the shoulder strap member 14. The indicia may be printed on the loop strap members 12 and/or the shoulder strap member 14 either before or after the inventive holder for a coin cup 10 is constructed. The indicia 30 may be printed using any of a variety of printing methods, such as hot stamping, screen printing, or the like.

With respect to the above description, it is realized that the optimum dimensional relationships for parts of the invention, including variations in size, materials, shape, form, function, and manner of operation, assembly and use, are deemed readily apparent and obvious to one skilled in the art. All equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention.

We claim:

1. A method of holding a slot machine coin cup, the coin cup having a tapered cylindrical bucket shape with a bottom diameter of the coin cup being less than a top diameter of the coin cup, comprising the steps of: providing a coin cup holder comprising a continuous closed-circle loop strap member defining a circular opening for receiving a coin cup within the circular opening, the diameter of the continuous closed-circle loop strap member being greater than the bottom diameter of the coin cup and less than the top diameter of the coin cup so that the continuous closed-circle loop strap member is effective for supporting the coin cup by demountably engaging with the peripheral surface of the coin cup, and a shoulder strap member for supporting the coin cup holder on a shoulder of a user comprising a first end fixed at a portion along the length of the loop strap member and a second end fixed at another portion along the length of the loop strap member so that the circumference of the loop strap member is bisected between the first end and the second end; and inserting the coin cup into the circular opening of the closed-circle loop strap member so that the closed-circular loop strap member is demountably engaged with the peripheral surface of the coin cup so as to become in tighter engagement with the coin cup depending on the weight of contents in the coin cup.

2. A method of holding a slot machine coin cup according to claim 1; wherein the shoulder strap member includes shoulder strap adjusting means for adjusting the length of the shoulder strap member.

3. A method of holding a slot machine coin cup according to claim 1; wherein the shoulder strap member is fixed to the loop strap member such that the first end and second end are fixed at an oblique angle relative to a longitudinal axis of the loop strap member.

4. A method of holding a slot machine coin cup according to claim 1; wherein the loop strap member includes loop strap adjusting means for adjusting the length of the loop strap member.

5. A method of holding a slot machine coin cup according to claim 1; wherein the closed-circle loop strap member has a fixed circumference between twelve and twenty inches.

* * * * *